United States Patent [19]

Wunder et al.

[11] 4,221,261

[45] Sep. 9, 1980

[54] BRAZELESS HEAT EXCHANGER OF THE TUBE AND SHELL TYPE

[75] Inventors: John E. Wunder; George Hronek; Thomas J. Gaudion, all of Dayton, Ohio

[73] Assignee: United Aircraft Products, Inc., Dayton, Ohio

[21] Appl. No.: 921,464

[22] Filed: Jul. 3, 1978

[51] Int. Cl.[3] ..... F28D 1/04; F28D 1/06; F28D 7/06; F28F 9/02

[52] U.S. Cl. ..... 165/74; 165/76; 165/158; 165/159; 165/176; 165/DIG. 8

[58] Field of Search ..... 165/74, 158, 159, 160, 165/173, 176, DIG. 8

[56] References Cited

U.S. PATENT DOCUMENTS

| | | | |
|---|---|---|---|
| 211,166 | 1/1879 | Lincoln, Jr. | 165/158 |
| 1,810,286 | 6/1931 | MacPhee | 165/158 X |
| 1,864,963 | 6/1932 | Vadersen | 165/74 |
| 1,904,875 | 4/1933 | Metzgar | 165/159 |
| 1,954,356 | 4/1934 | How | 165/160 |
| 2,715,516 | 8/1955 | Reinhold et al. | 165/159 |
| 2,811,337 | 10/1957 | Andersen | 165/159 X |
| 2,900,173 | 8/1959 | Pickford | 165/158 X |
| 3,244,225 | 4/1966 | Nevins | 165/74 |

FOREIGN PATENT DOCUMENTS

| | | | |
|---|---|---|---|
| 362883 | 7/1906 | France | 165/158 |
| 109929 | 10/1917 | United Kingdom | 165/158 |
| 763647 | 12/1956 | United Kingdom | 165/158 |
| 766614 | 1/1957 | United Kingdom | 165/158 |

*Primary Examiner*—Stephen Marcus
*Attorney, Agent, or Firm*—J. E. Beringer

[57] ABSTRACT

A tube and shell heat exchanger of a brazeless type. A single header construction mounts tubes made for high efficiency heat transfer and supported for damage free operation. A removable mounting plate confines a tube and header core in a shell and is adapted for free mounting and for controlled inflow and outflow of the tube side and shell side fluids. By-passing flow of shell side fluid within the shell is obviated by a recessed mounting of the header allowing a standard spacing of the tube bundle relatively to shell interior wall surfaces.

11 Claims, 10 Drawing Figures

FIG-1
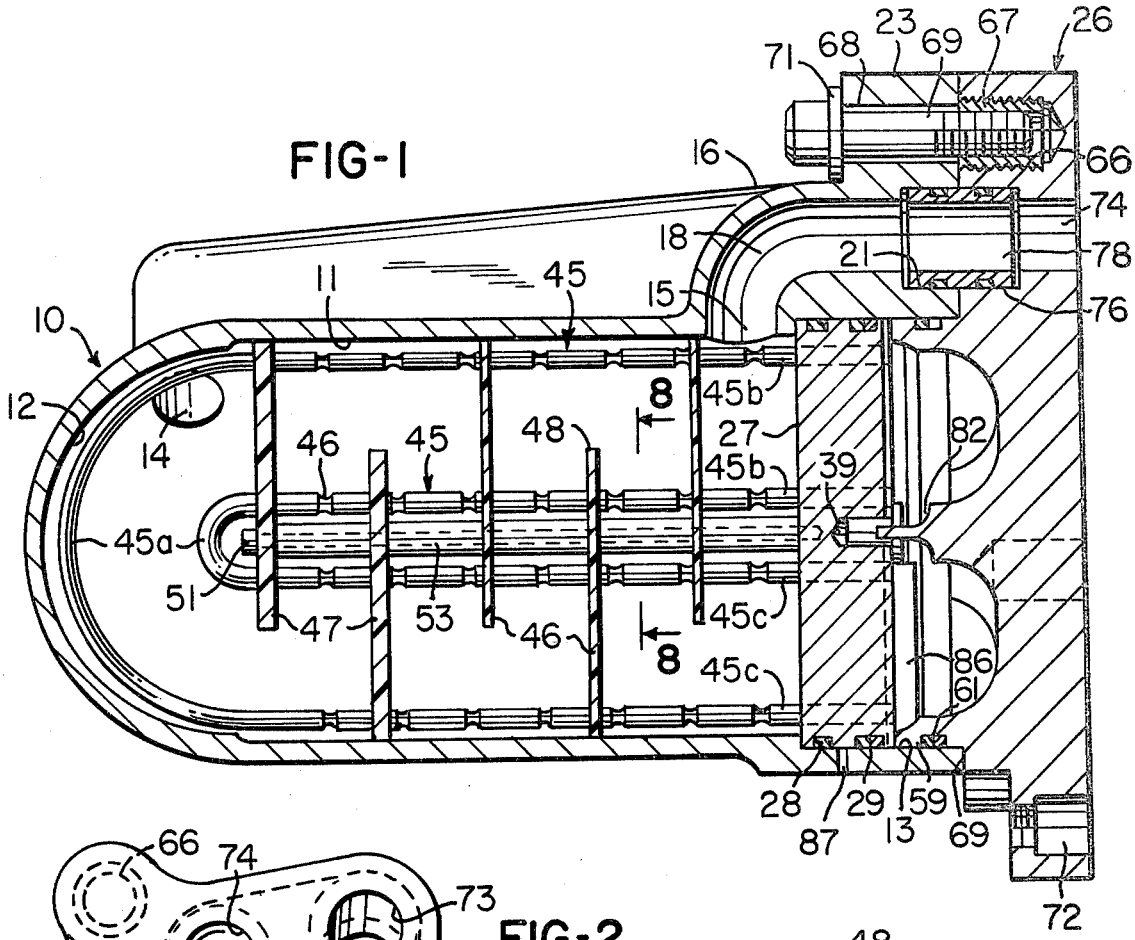
FIG-2
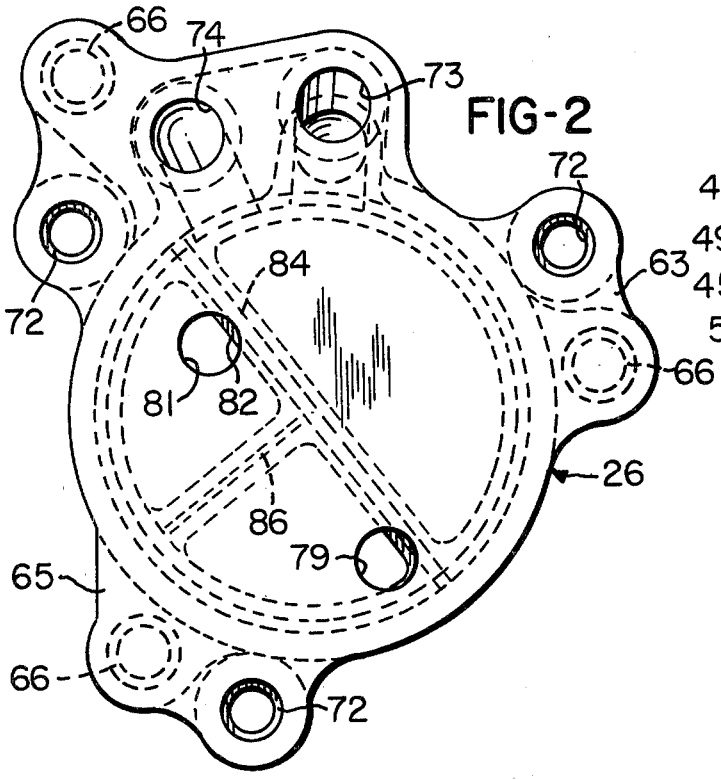
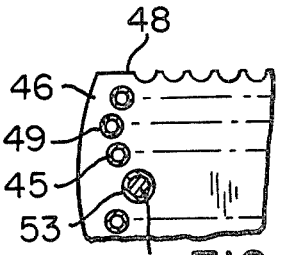
FIG-8
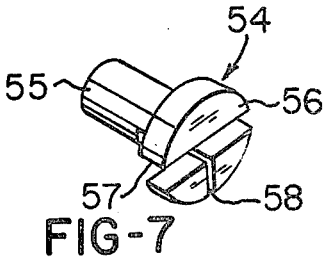
FIG-7

BRAZELESS HEAT EXCHANGER OF THE TUBE AND SHELL TYPE

BACKGROUND OF THE INVENTION

This invention is at least in part directed to an improvement in brazeless heat exchangers of the kind shown in Pfouts et al U.S. Pat. No. 4,029,145, dated June 14, 1977, the disclosure of which patent constitutes the most pertinent prior art known to applicants, and to others substantively involved in the preparation of this application, at the time of filing. Reference may also be made, however, in connection with certain disclosed tube configurations, to U.S. Pat. No. 2,864,588, issued Dec. 16, 1958.

The device of the prior patent is a brazeless heat exchanger of the tube and shell type offering distinct advantages in the field of compact, high performance heat exchangers. Disadvantages, insofar as they may be said to be present, relate to costs of production. Inasmuch as the brazeless concept is designed to replace a brazed heat exchanger, in which all parts are united in a single bonding step, the number of required parts, the number and complexity of assembly steps, and like cost factors, assume a high level of importance.

The present invention effects improvement over prior brazeless heat exchangers in all named cost factors and in general provides a compact, high performance brazeless heat exchanger of simple construction which is easily installed in fluid flowing systems and has good reliability in use.

SUMMARY OF THE INVENTION

In a physical embodiment of the invention, in accordance with the instant disclosure, a brazeless heat exchanger includes a shell housing having a cylindrical bore closed at its one end or bottom by a concave hemispherical surface and open at its opposite or outer end. A mounting plate is applied to the shell housing in a closing relation to the open end of the bore and is adapted for bolting both to the housing and to an external support, such as an engine frame. In the mounting plate are an inlet and an outlet for a shell side fluid and an inlet and an outlet for a tube side fluid. The fluids might, for example, be a recirculated lubricating oil and a flowing liquid fuel which it is desired to bring into a heat transfer relation to cool the oil or to heat the fuel or both.

A core is confined within the housing bore and includes a single multi-apertured header plate and U-shaped heat transffer tubes. Ends of the tubes are received in header apertures and swaged or otherwise fixed therein in a leak tight manner. Intermediate tube portions include straight sections projecting perpendicularly from the header and an interconnecting bent section. The header positions within the open outer end of the housing bore while intermediate tube portions extend into the bore with bent sections in an approaching, conforming relation to the hemispherical bottom. The header plate is confined in the housing by the mounting plate and the two have interengaging portions whereby tube side fluid admitted to the face of the header is conducted through the tube assembly in plural passes. To direct the shell side fluid to and from the bore, the housing has appropriate inlet and outlet passages communicating at their one ends respectively with the shell side fluid inlet and outlet in the mounting plate and at their opposite ends with longitudinally spaced apart bore locations. Baffle members are in the bore to compel the shell side fluid to a circuitous route in which it flows repeatedly across intermediate tube portions while moving generally longitudinally thereof. The baffle members seat to the cylindrical bore wall and are apertured for passage of the tubes therethrough. The tubes are relatively closely received within baffle apertures and are accordingly supported by the baffle members in their generally cantilever mounting and against rubbing contact with one another. The baffle members are made of a synthetic material, for example a tough inert polymer such as "teflon" having a cushioning effect on the tubes. Straight sections of intermediate tube portions have peripheral indentations or beads arranged to obviate a coinciding with transversely orienting baffle members. Bent tube portions are unbeaded.

Recessed peripherally into the header plate are O-ring or like seals. The presence of these seals dictates that the pattern of tube accommodating apertures in the header plate cannot be extended to near the header periphery. This can result in an undesirably wide spacing in the housing bore, between the tube bundle and the bore wall, allowing bypassing flow of shell side fluid. According to a feature of the invention, however, a counterbore is provided which directly receives the header plate and enables a normal or standard clearance between the periphery of the tube bundle and the interior bore wall.

An object of the invention is to provide a brazeless heat exchanger of the tube and shell type substantially as characterized in the foregoing.

Other objects and structural details of the invention will appear from the following description when read in connection with the accompanying drawings, wherein:

FIG. 1 is a view in longitudinal section of a brazeless heat exchanger in accordance with the illustrated embodiment of the invention;

FIG. 2 is an end view of the device of FIG. 1;

FIG. 7 is a detail view, in perspective, of an insert device used normally to close an extraction hole in the header plate;

FIG. 8 is a detail fragmentary view of a baffle member and intersecting tube;

Figure 9:
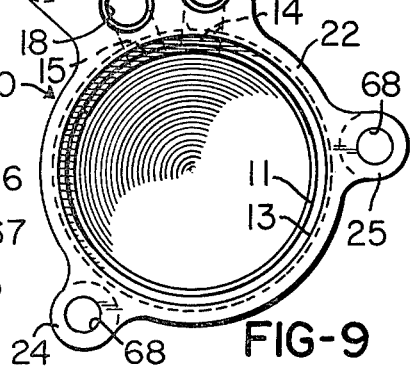
FIG. 9 is a detail end view, at a scale reduced relatively to other views, showing a front face of the shell housing.
Figure 6:
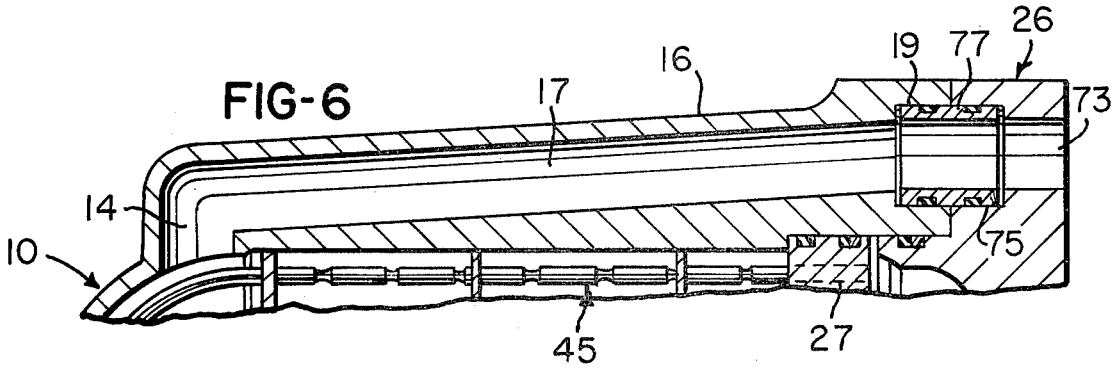
FIG. 6 is a fragmentary view in longitudinal section, showing a flow passage in the housing for the shell side fluid.

Referring to the drawings, in its illustrative form the heat exchanger is comprised of a generally tubular housing 10, acting as the shell of the heat exchanger, which may be made as a metal casting and then appropriately machined. A central bore 11 opens through one end of the housing and has a uniform cross sectional diameter over most of its length. At its blind or closed end, bore 11 terminates in a concave, hemispherical surface 12. At its opposite or open end is a counterbore 13 which over a relative short part of the bore length at its entrance end increases the effective bore diameter. Communicating with the housing bore, at longitudinally spaced apart locations, are shell side fluid openings 14 and 15. In a relatively enlarged peripheral portion 16 of the housing are flow passages 17 (FIG. 6) and 18 (FIG. 1) of longitudinal extent which at respective inner ends terminate in the openings 14 and 15. Outer ends of the flow passages open into respective counterbores 19 and 21 (see also FIG. 9) which in turn open through a front face 22 of the shell housing. The face 22 includes a front face of enlarged portion 16 and those of projecting tabs 23–25, which, as will be seen, provide points of attachment for a mounting plate 26.

Figure 5:
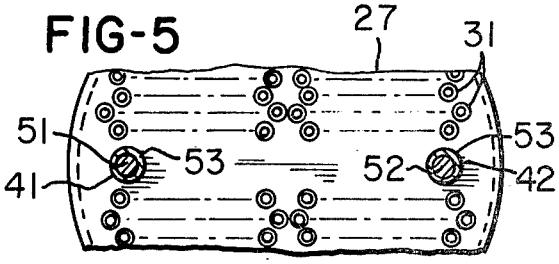
FIG. 5 is a fragmentary view like FIG. 4, showing the reverse face of the header plate.
Figure 4:
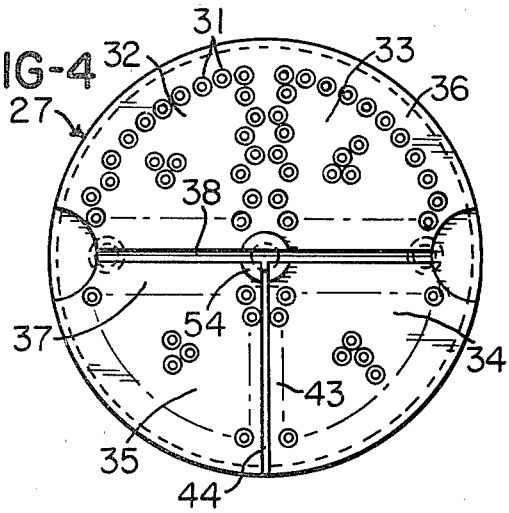
FIG. 4 is a detail end view, showing a front face of the header plate.

The counterbore 13 slidably receives a circular header plate 27 recessed into the periphery of which are spaced apart O-ring seals 28 and 29. The latter are compressed by contact with the wall of counterbore 13 and effectively inhibit an escape of or flow of fluid around a header as installed in the counterbore. In the header plate 27 is a multiplicity of tube accommodating through apertures or holes 31. The holes 31 are drilled or otherwise formed in the header 27 according to a dense pattern bringing adjacent holes, and thereby adjacent tubes, into closely spaced relationship with one another. For convenience of illustration, only a small number of holes 31 are shown in FIGS. 4 and 5 but it will be understood that at least certain portions of the header face are fully occupied by multiple, closely spaced holes. In this connection, however, it will be observed that, at least for descriptive purposes, the hole pattern can be said to occupy different quadrants 32, 33, 34 and 35 of the header. A peripheral land portion 36 separates the periphery of the hole pattern from the header periphery and allows recessing of the seals 28 and 29 therein. A middle, transverse land portion 37 separates the hole pattern into upper and lower halves and allows for the machining of a transverse slot 38 in what may be regarded as a front face of the header. Also, in the front face of the header, in land 37, is an axial tapped recess 39. In the reverse or back face of the header, but still in the land 37, are other tapped recesses 41 and 42, offset to either side of the header axis. Finally, a radial land 43, separating quadrants 34 and 35, is occupied, at the front face of the header, by a slot 44 in a perpendicular, intersecting relation to slot 38. Slot 44 is narrower than slot 38.

The holes 31 of the header plate 27 receive the ends of U-shaped tubes 45 made of a relatively thin, heat conductive and plastically deformable material. The tubes are extruded or otherwise made to be initially linear and with a uniform cross sectional dimension. In a subsequent step, annular indentations or beads 46 are formed along selected portions of the length of each tube. Thus, a mid portion 45*a* of each tube is left unbeaded as are tube extremities 45*b* and 45*c*. Between plain or unbeaded tube portions, the annular indentations or beads 46 appear in a longitudinally spaced relation, the spacing being uniform in the different tube portions and among the several tubes. After beading, the tubes are bent to a U-shape, the bending being symmetrical so that a formed tube presents straight or leg sections of substantially equal length and a continuously curving mid section interconnecting the straight or leg sections. The curving mid section is substantially fully comprised by unbeaded tube portion 45*a*. Unbeaded tube extremities 45*b* and 45*c* define free tube ends and are introduced into header holes 31 where they are fixed in a leak tight manner, as by swaging or the like. It will be understood that ends of the same tube are received in correspondingly located holes in different quadrants of the header plate. It may thus be useful to consider the header holes 31 as occurring in multiple rows. Accordingly, if a tube end 45*b* is introduced into a top row header hole of quadrant 32, then end 45*c* of the same tube is introduced into a correspondingly located header hole of another quadrant which for multi pass operation will be quadrant 35. FIG. 1 of the drawings illustrates only a pair of tubes 45, one interconnecting outermost related header holes of the hole pattern and the other interconnecting innermost related header holes. It will be understood that these are merely representative of a multiplicity of tubes wherein tube ends fill and are fixed in all tube accommodating holes of the header hole pattern. The multiplicity of tubes 45 may be termed a tube bundle and projects in cantilever fashion from header 27 into the housing bore. Bent mid portions 45*a* of the tubes extend toward and conform approximately to concave bore surface 12. Straight leg portions position substantially parallel to the side wall of bore 11. For appropriate nesting within the bore, the tubes are provided in a number of different lengths, the longest and shortest lengths being illustrated in FIG. 1. Beaded lengths are the same in the different tubes, different tube lengths being evidenced by varying lengths of unbeaded mid portions 45*a*.

The header 27 and tubes 45 are part of a core unit or assembly further including sets of baffle-support members 46 and 47. The members 46 and 47 have like functions and are identical in construction except that members 47, which position at outer reaches of the tube bundle, are made thicker for greater strength. Each member 46–47 is shaped substantially as a segment of a circular disc and positions within the housing bore in a transversely intersecting relation to the tube bundle. A curved edge of the member seats to the cylindrical wall of bore 11. A truncated edge 48 positions within the tube bundle, terminating short of contact with the bore wall. The baffle members have apertures 49 adapted for passage of the tubes 45 therethrough. They occupy longitudinally spaced positions within the tube bundle and are oriented reversely of one another so that truncated edges 48 of adjacent members overlap. The result, as will be understood, is to define a circuitous flow path for a shell side fluid compelling the fluid repeatedly to flow across the tube bundle as it moves in a sense longitudinally thereof as in traveling within the bore from opening 15 to opening 14. Apertures 49 in the baffle members are of a diameter relatively closely to receive individual tubes of the tube bundle. The several baffle members cooperate with one another, and with the wall of bore 11, in supporting the tube bundle in a projected position within the bore and in a spaced relation to the bore wall. Moreover, individual tubes are maintained in a separated relation, obviating damaging contact therebetween. The baffle members are made of an inert, tough, polymer material, for example "teflon". They accordingly provide a yield or cushion in the support of the tube bundle and exhibit relatively slick surfaces facilitating a projecting of tube ends through baffle apertures.

Still further comprised in the core unit or assembly is a pair of elongated bolts 51 and 52. Tips of the bolts are externally threaded and screwed into respective tapped recesses 41 and 42 of the header. The bolts 51 and 52 accordingly project perpendicularly from the back face of header 27 into the housing bore in peripheral portions of the tube bundle. Between the head of each bolt and the back face of the header is a series of spacer sleeves 53. These surround the bolt and cooperate with one another and with the bolt head and header face in establishing and maintaining a spaced relation of the baffle members. This relationship, as will be noted, is established with reference to the spacing of tube beads 46 so that the plane of none of the baffle members coincides with a tube bead. It further will be noted, in this connection, that since the bead spacing is the same in the leg sections of each tube, and is the same as among the several tubes, bead locations are in common transverse planes, thus facilitating a relatively offset location of the baffle members. The offset positioning of the baffle members, relatively to bead locations, insures positive support of all tubes intersecting each baffle member and obviates bypassing flow of shell side fluid through baffle apertures.

At the front face of header plate 27, tapped recess 39 is adapted to receive an extracting tool (not shown) which, when threaded into the recess, can be used to pull an installed core unit from the housing bore for inspection or servicing. Normally the recess is closed by a removable plug 54 (FIG. 7) made of a relatively firm but compressible material capable of acting as a seal. A shank portion 55 of the plug is insertable with a press fit in recess 39, filling the recess and preventing a bypassing of tube side fluid along the front face of the header by movement into and out of the recess. A head portion 56 positions outside the recess and seats to the front header face. In the head face, and penetrating into the shank portion 55, is a through transverse slot 57. Also in the head 56 and at right angles to slot 57 is a narrower, more shallow slot 58 of radial extent only. The slots 57 and 58 are adapted to coincide with and to act as continuations of respective header slots 38 and 44. With plug 54 installed in recess 39, and rotated to a proper orientation, the slots 57 and 58 align with and in effect become parts of the respective header slots 38 and 44.

Figure 3:
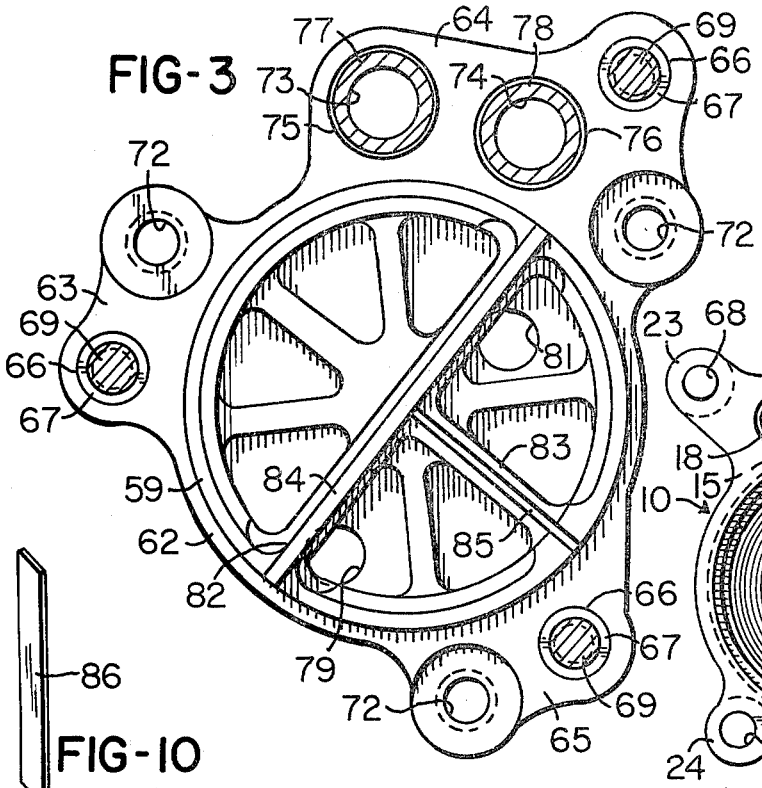
FIG. 3 is an inside front view of an end mounting plate, showing related spools and bolts in place.
Figure 10:
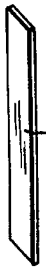
FIG. 10 is a detail view in perspective of a divider member used between the header plate and the mounting plate.

The mounting plate 26 is an irregularly shaped part which includes, on an inner face thereof, a cylindrical projecting portion 59. The latter is structured to have a sliding fit in counterbore 13 and on its exterior carries a recessed seal 61 for contact with the counterbore side wall. Surrounding the base of projecting portion 59 is a face 62 (FIG. 3) adapted for flush mating engagement with front face 22 of the shell housing. Face 62 is part of a circular flange which includes circumferentially spaced apart projecting segments 63, 64 and 65. Front faces of the projecting segments coincide with and form continuations of the face 62. Accordingly, an application of mounting plate 26 to the front of shell housing 10 may be used to introduce projecting portion 59 into counterbore 13 and continued until face 62 reaches a flush contact with face 22. Simultaneously therewith, front faces of the flange segments 63–65 reach a like flush contact with enlarged housing portion 16 and with housing tabs 23–25. Further, and in the course of bringing the mounting plate to a flush mating engagement with front faces of the housing, projecting portion 59 engages header 29, in the region of peripheral land 36, and presses it to a seat in the bottom of counterbore 13.

The mounting plate 26 is releasably fastened to housing 10, by bolting. In each flange segment 63–65 of the mounting plate is a tapped recess 66 opening through what may be regarded as an inner face of the mounting plate or that face forming a continuation of face 62. Installed in each recess 66 is a cylindrical insert 67, threaded on both its exterior and interior. By reason of its threaded mounting in recess 66, an installed insert 67 is positively locked therein against axial withdrawing movement. Adapted to align with each recess 66 is a through bore 68 in respective housing tabs or lugs 23–25. Bore 68 is somewhat smaller in diameter than its related recess 66 and somewhat larger than the inside diameter of insert 67. A bolt 69 has a shank portion extending through each bore 68 and a threaded end screwed into a respective insert 67. Each bolt 69 has a head flange 71 abutting the housing exterior, and it will be evident that by turning the bolts 69 inward until respective flanges 71 abut the housing, mounting plate 26 may be drawn up for a close fitting engagement of housing and plate surfaces 22 and 62.

Also in each mounting plate segment 63–65 is a two diameter through bore 72, useful (in a manner not here shown) in a bolting of an assembled heat exchanger to an engine frame or like mounting place.

In a generally side by side relation in flange segment 64 are through bores 73 and 74 in which are respective counterbores 75 and 76 opening through the inner face of the mounting plate or toward housing enlargement 16. Counterbores 75 and 76 are of the same diameter as, and are adapted to register with, housing counterbores 19 and 21. Installed in to bridge mating counterbores 19 and 75 is a spool 77. A like spool 78 is installed in and bridges counterbores 21 and 76. Peripheral seals are inset into each spool 77 and 78 on opposite sides of a parting line as defined by mating faces 22 and 62.

Bores 73 and 74 function alternatively as the inlet and outlet for a shell side fluid. Spools 77 and 78 assist in an angular positioning of the mounting plate and inhibit an escape of fluid along mating surfaces 22 and 62 as the fluid moves from bore 74 into flow passage 18 and from flow passage 17 to bore 73, or vice versa.

Within a circular area as defined by projecting portion 59, the mounting plate has openings 79 and 81 serving as the inlet and outlet for a tube side fluid. Within the described area, the inner face of the mounting plate is cut away to leave an open chambered area between the mounting plate and a front face of header 27. Also, there is defined thereby a transverse elevated land 82, and a radial land 83 perpendicular to land 82. A raised rib 84 projects from land 82 while in land 83 is slot 85. Rib 84 is adapted to be closely received in slot 38 in header 27. Slot 85 is dimensioned like and is adapted to align with header slot 44. A thin divider member 86 engages in slot 85 and projects therefrom to enter header slot 44 and its continuation 58 in plug 54. The arrangement, as will be seen, is one to divide the chambered area in front of header 27 into portions on either side of rib 84. Further, on one side of the rib, the chambered area is sub-divided by member 86 into a first area opposite quadrant 34 of the header and a second area opposite quadrant 35. Openings 79 and 81 communicate respectively with the defined first and second chambered areas. On the other side of rib 84, header quadrants 32 and 33 are in common communication with one another through the facing chambered areas on the said other side of the rib.

In the operation of the heat exchanger, a tube side fluid under pressure is suitably conducted to the device and allowed to enter an opening 79 or 81 selected as the inlet, for example 79. The admitted fluid finds itself confined by rib 84 and divider 86 to a chambered area facing header quadrant 34. It distributes itself over quadrant 34 and flows simultaneously into tube ends there presented. Conducted by the pertaining tubes 45, the fluid flows the length of bore 11 toward the bottom thereof, reverses direction in bends 45*a*, and flows back longitudinally of the bore to return to the header from which it emerges through quadrant 33. In the chambered area in which the fluid now finds itself it has access only to tube ends in quadrant 32. Entering these tube ends, the fluid is conducted by pertaining tubes 45 the length of bore 11 and back again, emerging this time through header quadrant 35. Under confinement of rib 84 and divider 86, the fluid is now denied further access to the tube bundle and must exit the device through outlet opening 81.

The shell side fluid is suitably brought to the heat exchanger and admitted thereto by way of an opening 73 or 74, for example opening 74. It has access through spool 78 to housing passage 18 and is directed thereby to opening 15 where it enters bore 11 at a location adjacent to the back face of header 27 and in a sense transversely of the straight leg sections of tubes 45. Within bore 11, the shell side fluid moves circuitously to opening 14, the flow path being one taking the fluid repeatedly back and forth across the tube bundle. In flowing over, around and between the tubes 45, the shell side fluid is in heat transfer relation to the tube side fluid flowing through the tubes. There is accordingly a transfer of heat between the fluids appropriate to such established conditions as tube wall thickness, amount of heat transfer surface, fluid temperatures, fluid flow velocities and the like. In this connection, annular indentations or beads 46 act as flow restrictors for the tube side fluid, at the location of which fluid flow is increased in velocity. Along the beaded parts of the tube, therefore, the tube side fluid has intermittent increases in velocity, with accompanying turbulence, scrubbing the interior tube wall free of fluid film layers which tend to reduce heat transfer efficiency. Bent portions 45*a* of the tubes are essentially turnaround sections. Beads can be omitted from these sections without appreciable loss of heat transfer efficiency, and, in so doing, potential flow problems and structural problems are avoided.

With respect to the shell side fluid, it will be observed that peripheral portions of the tube bundle position in a relatively closely spaced relation to the bore wall. Bypassing flow of the shell side fluid around the tube bundle accordingly is inhibited, substantially the full volume of such flow being compelled to follow a flow path as defined by baffle members 46–47. Counterbore 13 positively positions header 27 in a longitudinal sense, and, in relatively recessing a peripheral portion of the header, allows the pattern of holes 31 therein to conform relatively closely to transverse dimensions of the tube accommodating bore.

The manner of assembly of the heat exchanger will largely be self evident. Preformed bent tubes 45, and bolts 51 and 52 are inserted through successive baffles 46–47, with spacer sleeves 53 being added following insertion through the successive baffles. Tube ends are introduced into appropriate apertures 31 in header 27 and fixed therein. These operations produce a core unit or assembly which is put into place in housing 10 substantially in a position as shown in FIG. 1. Plug 54 is inserted in recess 39 and rotatively adjusted so that its slots 57 and 58 align with header slots 38 and 44. Mounting plate 26 is then applied to the housing in an angular orientation to align recesses 66 with bolt passing openings 68. In the process, the core unit is rotatively adjusted so that slot 38 therein aligns with rib 84. The mounting plate can then be temporarily removed to have spools 77 and 78 inserted in counterbores 75 and 76, and to have divider 86 installed in slot 85. Now, if mounting plate 26 is reapplied to the housing in the same angular orientation as before, spools 77 and 78 enter housing counterbores 19 and 21, and rib 84 and divider 86 respectively enter header slots 38 and 44. Upon bolts 69 being installed and tightened, a unitary heat exchanger is completed, the parts of which are not required to be metallurgically bonded together and which can be readily disassembled and reassembled for inspection and servicing.

When header 27 is fully inserted in counterbore 13, the peripheral seals 28 and 29 therein position to opposite sides of a drain hole 87 in the housing. In the event of failure or part failure of a seal, therefore, leaking fluid will have an escape route to the housing exterior. The possibility of seal failure leading to mixing of the tube side and shell side fluids is accordingly remote.

It will be evident that modification in details of the disclosed heat exchanger are possible. For example, by omitting the divider 86 and by placing inlet and outlet openings 79 and 81 on opposite sides of rib 84, the device could be made to function as a two pass heat exchanger rather than a four pass as in the illustrative embodiment. Also, while the partly beaded tubes as shown are usefully employed, the tubes may be left plain or unbeaded if heat transfer requirements permit. Any or all of the provided O-ring seals may be provided with retainers or back-up rings for more secure sealing, if found desirable.

These and other modifications, which will be obvious to those skilled in the art, are regarded as being embraced by disclosed invention concepts.

What is claimed is:

1. A brazeless heat exchanger of the tube and shell type, including a. a tubular shell closed at one end and open at the other;

b. at least a portion of the open end of said shell being generally radially enlarged and having formed therein inlet and outlet flow passages for a shell side fluid opening at their one ends into the shell interior at longitudinally spaced apart locations therein;

c. opposite ends of said passages opening through said enlarged shell portion at the said open end of said shell;

d. a mounting plate fixed to said shell in a substantially closing relation to the said open end thereof;

e. said mounting plate having inlet and outlet openings for the shell side fluid aligning in the installation of said mounting plate with the said opposite ends of said inlet and outlet flow passages;

f. said mounting plate having other inlet and outlet openings for a tube side fluid;

g. a header plate confined by said mounting plate to a position within the open end of said shell;

h. said mounting plate and said header plate cooperating to define separated inlet and outlet chambered areas therebetween communicating respectively with the said inlet and outlet openings for the tube side fluid;

i. means for establishing a peripheral seal about said header plate inhibiting a mixing of tube side and shell side fluids around the header plate periphery;

j. a plurality of U-shaped tubes having their opposite ends fixed in apertures in said header plate and their intermediate portions accommodated in said shell;

k. at least certain of said tubes having their one ends communicating through said header plate with said inlet chambered area and their opposite ends communicating through said header plate with said outlet chambered area; and l. means for directing shell side fluid through said shell interior from said one end of said inlet flow passage for shell side fluid to the said one end of the outlet flow passage in a path taking it in plural passes over intermediate portions of said tubes.

2. A brazeless heat exchanger according to claim 1, a. said directing means including longitudinally spaced apart segmental baffle members projecting radially inwardly from side walls of the shell interior;

b. bolt means set in said header plate to project perpendicularly therefrom into said shell;

c. said bolt means extending through said baffle members; and d. spacer means on said bolt means effecting a positive longitudinal spacing of said baffle members.

3. A brazeless heat exchanger according to claim 1, a. said directing means including longitudinally spaced apart segmental baffle members projecting radially inwardly from side walls of the shell interior and having edge portions adapted to make a sliding contact with said side walls of the shell interior and being apertured for passage of said tubes therethrough;

b. said baffle members being made of an inert tough polymer material; and c. tube accommodating apertures therein being sized for a substantially sliding fit of tubes therein.

4. A brazeless heat exchanger according to claim 1, a. the intermediate portion of each of said tubes including relatively elongated substantially parallel straight sections and an interconnecting bent section;

b. said straight sections being formed with longitudinally spaced apart annular indentations defining interior flow restricting beads; and c. said bent sections being unbeaded.

5. A brazeless heat exchanger according to claim 4, a. said shell providing a recess having straight side walls and an arcuately formed bottom; and b. straight sections of said tubes positioning in a parallel relation to said side walls and bent portions being formed in conformance with the curvature of said recess bottom.

6. A brazeless heat exchanger according to claim 5, a. said tubes forming a circular assembly in which radially outwardly positioning tubes are of greater length than tubes positioning radially inwardly thereof;

b. straight sections of all said tubes being of substantially equal length and bent portions of outwardly positioning tubes being of greater length than relatively inwardly positioning tubes; and c. corresponding annular indentations of different straight sections of a same tube and of adjacent tubes aligning in a substantially common transverse plane.

7. A brazeless heat exchanger according to claim 6, a. said directing means including longitudinally spaced apart segmental baffle members through which straight sections of said tubes extend; and b. means for positively spacing said baffle members so that none thereof occupy any of the substantially common planes in which said annular indentations appear.

8. A brazeless heat exchanger according to claim 1, a. said header plate, said tubes and said means for directing shell side fluid forming a unitary assembly removably installed in said shell;

b. said means for directing shell side fluid comprising plural segmental baffle members in a transverse intersecting relation to said tubes; and c. means fixed to said header plate establishing an interconnected spaced apart relation of said baffle members relatively to one another and to said header plate.

9. A brazeless heat exchanger according to claim 1, a. said shell providing a bore to accommodate said tubes and a counterbore to accommodate said header plate;

b. and said plurality of U-shaped tubes forming a tube bundle peripheral portions of which are fixed in said header plate inwardly of the periphery of said plate and in a position relatively closely to approach side walls of said bore; and c. the periphery of said header plate having sealing means recessed therein for sealing contact with the side wall of said counterbore.

10. A brazeless heat exchanger according to claim 9, a. an inner face of said mounting plate having a projecting portion to seat said header plate to the bottom of said counterbore;

b. an outer face of said header plate being slotted; and c. means projected by said inner face of said mounting plate fitting in said slot to define separated chamber areas between said header plate and said mounting plate.

11. A brazeless heat exchanger according to claim 10, a. and means bridging the shell side fluid inlet and outlet openings in said mounting plate and aligning inlet and outlet passages in said enlarged shell portion positively locating said shell and mounting plate in a rotary sense and sealing against the escape of shell side fluid therebetween.

* * * * *